US009821996B2

(12) United States Patent
Stratton

(10) Patent No.: US 9,821,996 B2
(45) Date of Patent: Nov. 21, 2017

(54) BEVERAGE DISPENSING APPARATUS AND METHOD

(71) Applicant: Gus J. Stratton, La Verne, CA (US)

(72) Inventor: Gus J. Stratton, La Verne, CA (US)

( * ) Notice: Subject to any disclaimer, the term of this patent is extended or adjusted under 35 U.S.C. 154(b) by 0 days.

(21) Appl. No.: 15/180,221

(22) Filed: Jun. 13, 2016

(65) Prior Publication Data

US 2016/0362288 A1 Dec. 15, 2016

Related U.S. Application Data

(63) Continuation-in-part of application No. 13/433,853, filed on Mar. 29, 2012, now Pat. No. 9,365,405.

(60) Provisional application No. 61/600,365, filed on Feb. 17, 2012.

(51) Int. Cl.
*B67D 3/00* (2006.01)
*B67D 3/04* (2006.01)

(52) U.S. Cl.
CPC ..... *B67D 3/0012* (2013.01); *B67D 3/0067* (2013.01); *B67D 3/041* (2013.01); *B67D 3/0009* (2013.01); *B67D 3/0029* (2013.01); *B67D 3/0083* (2013.01); *B67D 2210/0012* (2013.01); *B67D 2210/00163* (2013.01)

(58) Field of Classification Search
CPC .... B67D 3/0012; B67D 3/0067; B67D 3/041; B67D 3/0009; B67D 3/0029; B67D 2210/0012; B67D 2210/00163; B67D 3/0083
USPC ..... 222/1, 105
See application file for complete search history.

(56) References Cited

U.S. PATENT DOCUMENTS

| | | | |
|---|---|---|---|
| 2,858,051 | A | 10/1958 | Cunningham et al. |
| 3,790,029 | A | 2/1974 | Ward |
| RE30,301 | E | 6/1980 | Zygiel |
| 4,771,917 | A | 9/1988 | Heaps, Jr. et al. |
| 4,934,567 | A | 6/1990 | Vahjen et al. |
| 5,000,352 | A | 3/1991 | Cleland |
| 5,082,143 | A | 1/1992 | Schramm, Jr. |
| 5,575,405 | A | 11/1996 | Stratton et al. |
| 5,738,248 | A | 4/1998 | Green |
| 5,743,433 | A | 4/1998 | Hawkins et al. |
| 5,788,449 | A | 8/1998 | Riemersma |
| 6,045,007 | A | 4/2000 | Simmons |
| 6,059,145 | A | 5/2000 | Stratton et al. |
| 6,142,661 | A | 11/2000 | Lafond |
| 6,364,159 | B1 | 4/2002 | Newman et al. |
| 6,550,642 | B2 | 4/2003 | Newman et al. |

(Continued)

*Primary Examiner* — Donnell Long
(74) *Attorney, Agent, or Firm* — Brooks Kushman P.C.

(57) ABSTRACT

A beverage dispensing apparatus with a dispenser compartment, a flexible concentrate bag with a first opening through which a beverage concentrate is introduced at a production site and optionally a second opening at the top of the bag. The second opening is used at the dispensing location to introduce a diluent into the bag. A low acid beverage concentrate is contained in the bag. A beverage homogenizing agitator subassembly is situated inside the dispenser compartment. A beverage dispensing subassembly includes a sealed fitting located at the bottom region of the bag and a tube extending therefrom. The beverage dispensing apparatus reduces shipping and maintenance costs due to shipping concentrate rather than a finished beverage while enhancing sanitation.

11 Claims, 7 Drawing Sheets

(56) References Cited

U.S. PATENT DOCUMENTS

| | | | | |
|---|---|---|---|---|
| 6,796,459 | B2 * | 9/2004 | Johnson | B67D 1/0016 222/129.1 |
| 7,334,702 | B2 | 2/2008 | Cunningham et al. | |
| 7,810,679 | B2 | 10/2010 | Wauters et al. | |
| 8,210,736 | B2 | 7/2012 | Raber | |
| 8,499,972 | B1 | 8/2013 | Landry | |
| 2004/0206780 | A1 | 10/2004 | Sterner et al. | |
| 2007/0114243 | A1 | 5/2007 | Kershaw et al. | |
| 2008/0078781 | A1 | 4/2008 | Py et al. | |
| 2010/0206900 | A1 | 8/2010 | Dobrusskin et al. | |
| 2012/0104020 | A1 | 5/2012 | Cur et al. | |

* cited by examiner

BEVERAGE DISPENSING APPARATUS AND METHOD

CROSS-REFERENCE TO RELATED APPLICATIONS

This application is a continuation-in-part of U.S. application Ser. No. 13/433,853 filed Mar. 29, 2012, which, in turn, claims the benefit of U.S. provisional application Ser. No. 61/600,365, filed Feb. 17, 2012, the disclosures of which are hereby incorporated in their entirety by reference herein.

FIELD OF THE INVENTION

The invention is directed to beverage dispensing systems, and, more specifically, to systems for dispensing low-acid beverages.

BACKGROUND OF THE INVENTION

A major problem with prior art systems is bacteria growth. This is especially a problem when dispensing low-acid beverages (beverages having a pH of greater than 4.6). Bacteria tends to grow up from the opening in the distribution tube, upstream towards the flexible bag. Such bacterial growth can contaminate the pump and the water transfer line. This can at least lead to serious maintenance problems.

Additional problems with beverage dispensing systems of the prior art arise from the fact that the finished beverage is fully prepared at a production location and then shipped in the flexible bag to a dispensing location. First of all, the additional weight of the finished beverage results in large costs of shipment. Secondly, low-acid finished beverages must be refrigerated during shipment, resulting in still larger costs of shipment.

Among the art considered in preparing the present patent application are: U.S. Pat. Nos. 2,858,051; 3,790,029; RE30301; 4,771,917; 4,934,567; 5,000,352; 5,082,143; 5,575,405; 5,738,248; 5,788,449; 6,364,159; 6,550,642; 5,743,433; 6,045,007; 6,059,145; 6,142,661; 6,550,642; 7,334,702; 7,810,679; 8,210,736; 8,499,972 and U.S. patent publication Nos. 2004/0206780; 2007/0114243; 2008/0078781; 2010/0206900; and 2012/0104020.

SUMMARY OF THE INVENTION

The invention satisfies this need. In one embodiment (FIGS. 1-6) a beverage dispensing apparatus is used for dispensing a finished beverage. In one embodiment, the apparatus has (a) a dispenser compartment with one or more bins;

(b) a flexible concentrate bag situated within a bin in the dispenser compartment, the bag having a first opening at an lower end region of the bag through which a beverage concentrate is introduced at a production site before emplacement in the bin and through which the finished beverage is dispensed at a dispensing location after emplacement in the bin, and a second opening at the upper edge region of the bag, the second opening being used at the dispensing location to introduce a diluent into the bag (in a second embodiment there are two orifices (in an alternate embodiment, there are two openings at the upper edge region: one is centrally located and is used to introduce a diluent at the distribution facility; the other is used to introduce concentrate at the retail or dispensing facility), (c) the beverage concentrate including a low acid beverage concentrate having a pH greater than 4.6;

(c) a beverage homogenizing agitator subassembly situated inside the dispenser compartment in communication with the one or more bins and outside the bag proximate the bottom of the bag, the mixer being adapted to minimize sedimentation and to mix the beverage concentrate and the diluent within the bag by agitating at least the bottom region of the bag from the outside of the bag and its contents to form the finished beverage; and (d) a dispenser outlet subassembly including a sealed fitting located at the bottom region of the bag and a tube extending therefrom, the tube having an upstream end extending from the fitting;

an intermediate region downstream from the upstream end; and a downstream end through which the beverage is dispensed, the downstream end having a terminal portion that can be severed to open the downstream end, the dispenser outlet subassembly also being hermetically sealed and having a pinch cam attached to the dispenser compartment and an activation means for closing and opening the tube at the intermediate region, the dispenser outlet subassembly being in communication with the first opening of the bag, the dispenser outlet subassembly through which the finished beverage is dispensed at a dispensing location being in fluid tight communication with the bag so that any growth of bacteria is limited;

wherein the second opening for receiving the diluent is disposed upstream from the dispensing subassembly, the beverage dispensing apparatus reducing shipping and maintenance costs due to shipping concentrate rather than a finished beverage while enhancing sanitation.

FIG. 7 is a series of process flow steps to exemplify one method of using the invention as disclosed.

FIG. 8 depicts an optional bag design. In FIG. 8, a first opening is provided at an upper end region of the bag. Through that opening, at a retail or dispensing facility, a concentrate can be added to the bag. A second orifice is also provided at an upper end region of the bag through which a diluent may be added to the bag at the retail or dispensing facility. A third opening is provided in a lower region of the bag. It is through the third opening that the mixed beverage is dispensed.

BRIEF DESCRIPTION OF THE SEVERAL VIEWS OF THE DRAWINGS

These and other features, aspects and advantages of the present invention will become better understood with reference to the following description, appended claims and accompanying drawings where:

DETAILED DESCRIPTION OF THE INVENTION

Figure 1:
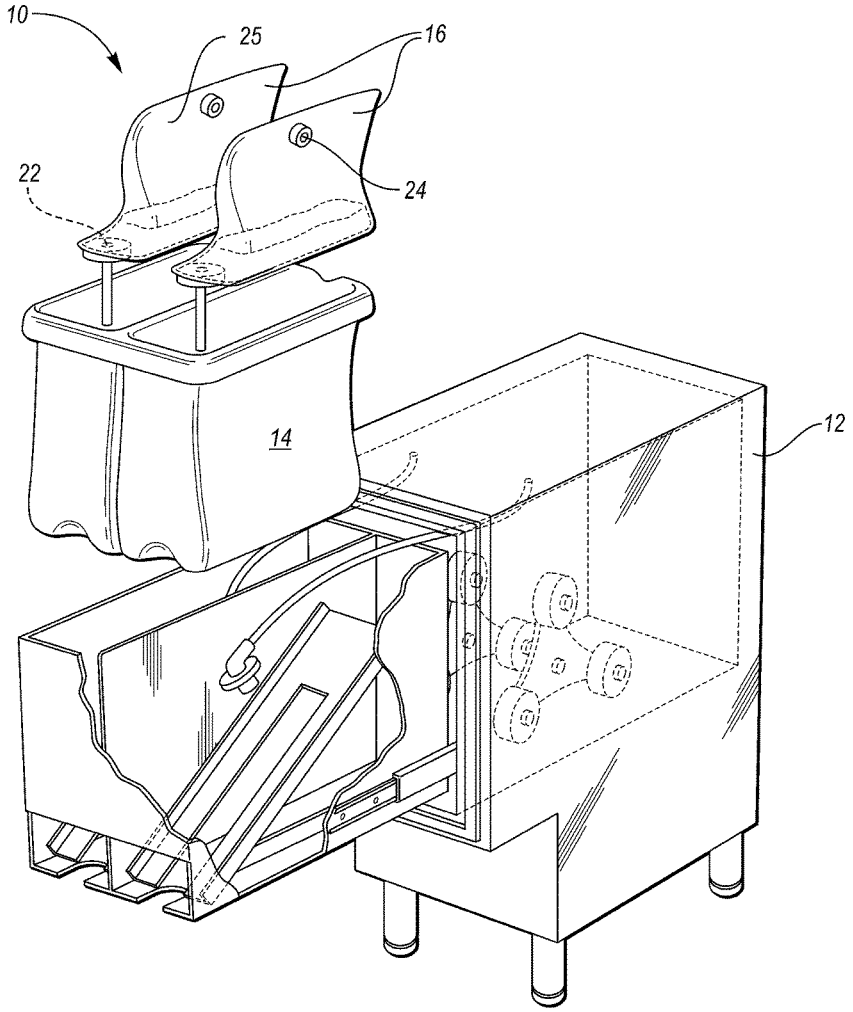
FIG. 1 shows one embodiment of a novel beverage dispensing system.

In FIGS. 1-6 of the drawings there is depicted a beverage dispensing apparatus 10 for dispensing a finished beverage 100. The apparatus includes a dispenser compartment 12 with one or more bins 14. A flexible concentrate bag 16 is situated within a bin 14 (see, e.g., FIGS. 1-2) in the dispenser compartment 12.

A representative bag 16 has a first opening 18 at a lower end region 20 of the bag 16 (see, e.g., FIGS. 3-4) through which a beverage concentrate 22 is introduced at a production site before the bag 16 is emplaced in the bin 14. Through that same first opening 18, the finished beverage 100 is dispensed at a dispensing location after the bag 16 is emplaced in the bin 14 and its contents agitated for mixing the concentrate 22 and a diluent 26. A second opening 24 is provided in the top region 25 of the bag 16. The second opening 24 is used at the dispensing location to introduce the diluent 26 into the bag 16. Preferably the diluent includes water in some form, e.g., tap water, ionized water, spring water and other safe drinking waters. Alternatively the diluent may take the form of a flavored water.

Preferably, the beverage concentrate 22 includes a low acid beverage concentrate having a pH greater than 4.6. One example is horchata. As used herein the term "horchata" generally connotes a beverage made from such ingredients as ground almonds, sesame seeds, rice, barley, or tigernuts. See, https://en.wikipedia.org/wiki/Horchata. The beverage presents challenges to sanitation and hygiene if its freshness is to be retained by conventional methods.

A beverage homogenizing agitator subassembly 28 (FIG. 5) is situated inside the dispenser compartment 12. The subassembly 28 lies in communication with for example a tray that lies at the bottom of the one or more bins 14 and outside the bag 16 proximate the bottom region 30 of the bag 16. The subassembly 28 is adapted to minimize sedimentation and to mix the beverage concentrate 22 and the diluent 32 within the bag 16 by agitating at least the bottom region 30 of the bag from the outside of the bag 16 and its contents to form the finished beverage 100.

Figure 4:
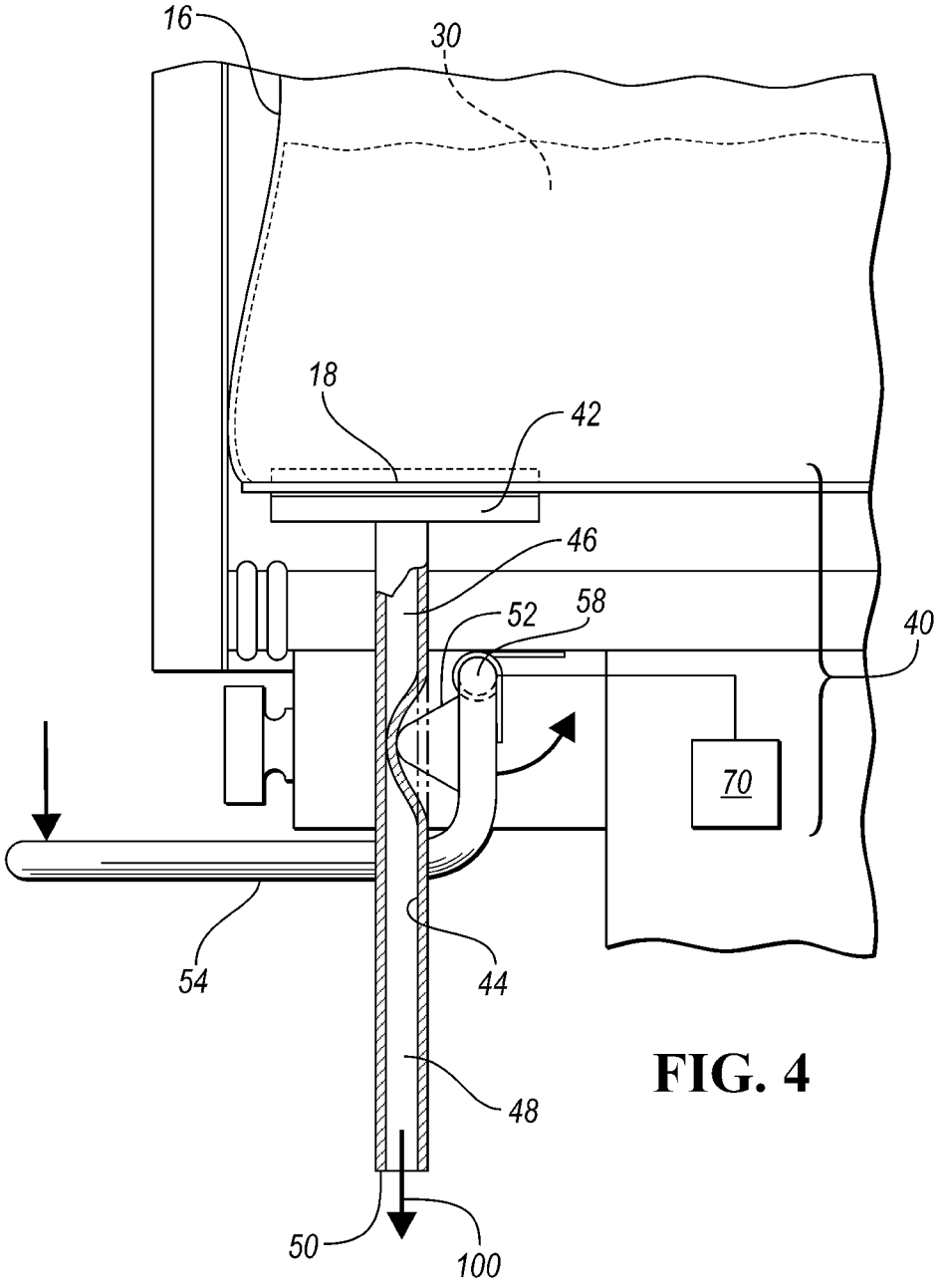
FIG. 4 is a cross sectional view of one embodiment of a beverage dispensing subassembly.

With primary reference to FIG. 4, a dispenser outlet subassembly 40 includes a sealed fitting 42 located at the bottom region 30 of the bag 30 and a tube 44 extending therefrom. The tube 44 has an upstream end region 46 extending from the fitting 42. An intermediate region 48 lies downstream from the upstream end region 46. A downstream end region 48 allows the mixed finished beverage 10 to be dispensed. The downstream end region has a terminal portion 50 that can be severed to open the downstream end region 48. Before dispensing the finished beverage the tube 44 had a sealed end to enhance sanitation during production, transportation and storage. In use, the dispenser outlet subassembly 40 is thus hermetically sealed before and after dispensing the finished beverage.

A pinch cam 52 is mounted in the dispenser compartment 12. An activation means 54 is provided for closing and opening the tube at the intermediate region 44. The dispenser outlet subassembly 40 is in communication with the first opening 18 of the bag 16. The dispenser outlet subassembly 40 enables the finished beverage 100 to be dispensed at for example a retail facility hygienically because it is in fluid tight communication with the bag 16 so that any growth of bacteria is limited.

Figure 2:
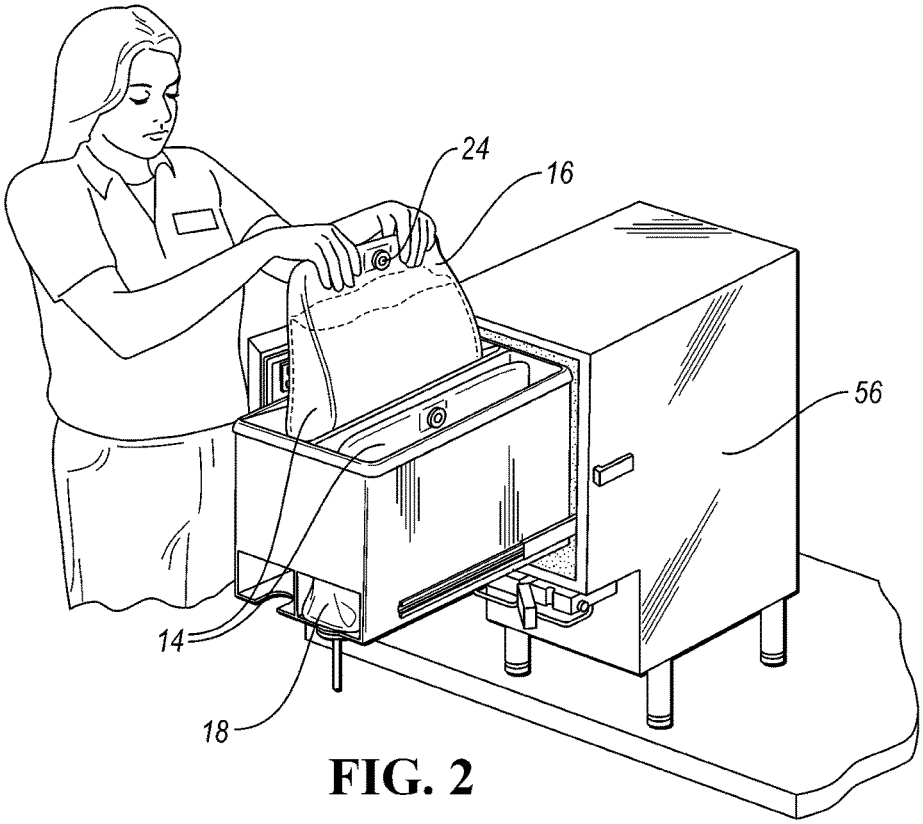
FIG. 2 illustrates a step of manually inserting a concentrate-laden bag into a sling associated with a drawer of the beverage dispensing system.
Figure 3:
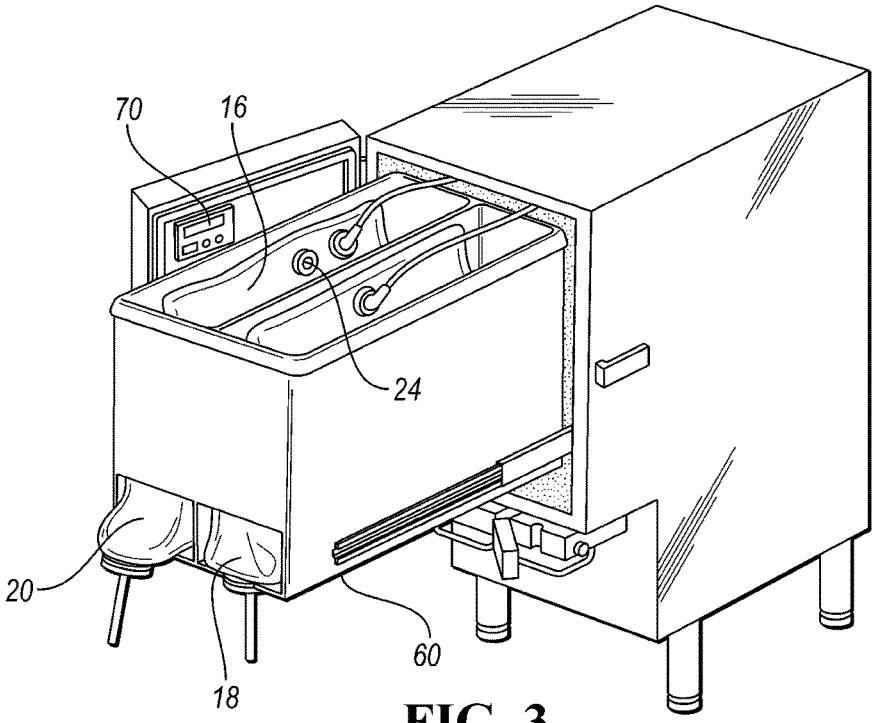
FIG. 3 shows a drawer containing multiple bags before the drawer is slid inwardly.

As shown in FIGS. 1-3, the second opening 24 for receiving the diluent is disposed upstream from the dispensing subassembly 40.

When deployed as described, the beverage dispensing apparatus 10 reduces shipping and maintenance costs. This is due in part to shipping concentrate rather than a finished beverage.

Preferably, the beverage dispensing apparatus 10 includes a refrigeration unit 56 (FIG. 2) associated with the dispenser compartment 12. As exemplified in FIG. 2, there are two bins 14.

FIG. 4 illustrates one embodiment in which the beverage dispensing apparatus 10 has an activation means 40 that includes a lever 54 that extends from a pivot 58. Alternatively, the activation means 40 includes a button that is adapted to be depressed and is biased to an outward closed condition.

The beverage dispensing apparatus of claim 1, further including one or more drawers 60 (FIG. 3) with one or more racks or slings 14 that receive the bags 16 so that the bags 16 are suspended in a vertical orientation thereby.

Figure 5:
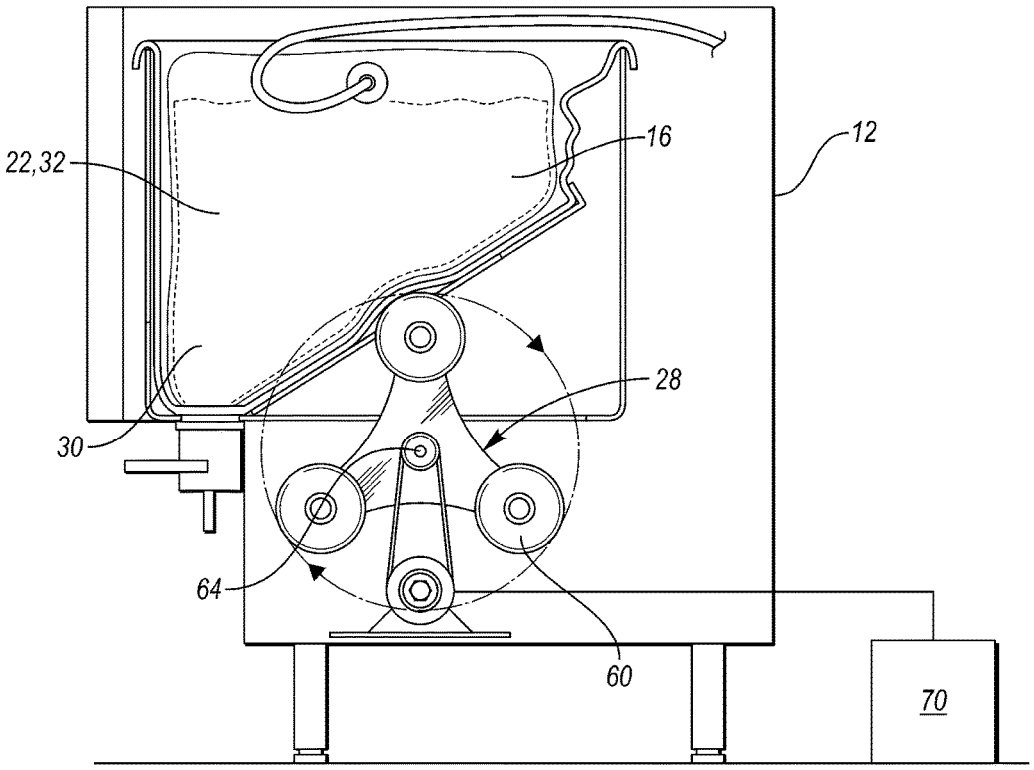
FIG. 5 is a cross sectional view of one embodiment of an agitator subassembly.

Referring to FIG. 5, one embodiment of the agitator subassembly 28 has one or more nodules 60 that are supported by arms 62 that radially extend from a hub 64. Preferably, the nodules 60 have rounded surfaces that engage the bag 16 and agitate the bag 16 and its contents as the beverage agitator subassembly 40 rotates there below. In some cases there is one agitator subassembly 40 associated with each bag 16.

Optionally, a control unit 70 (FIGS. 3-5) communicates with the agitator subassembly 40, the dispenser outlet subassembly 40 or both in order to influence the filling of the bags with a diluent and agitating the bags.

Figure 6A:
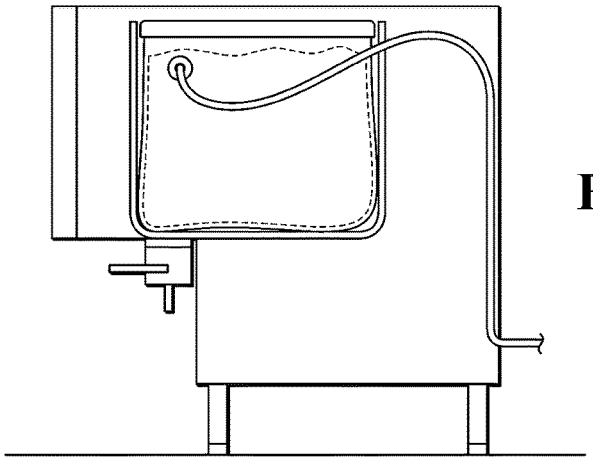
FIG. 6 is a cross sectional view of a second embodiment of an agitator subassembly.
Figure 6B:
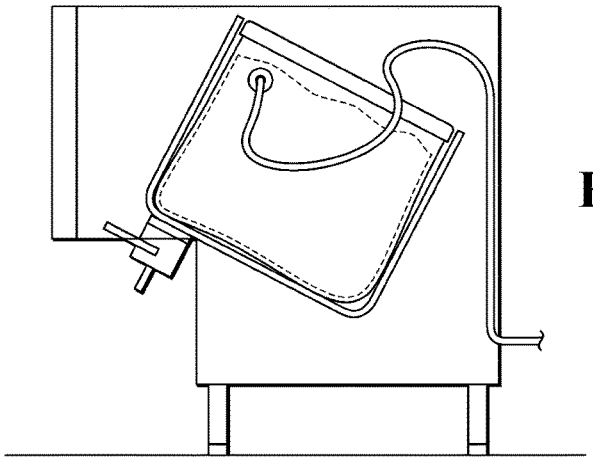
Figure 6C:
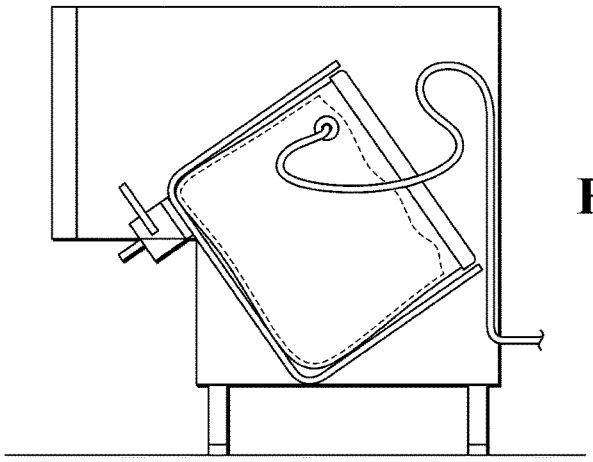

FIG. 6 shows another way to agitate the concentrate and the diluent. As shown, after the diluent is added to the concentrate, both the bag and its contents are rotated back and forth in combination with their associated bins and drawers.

Figure 7:
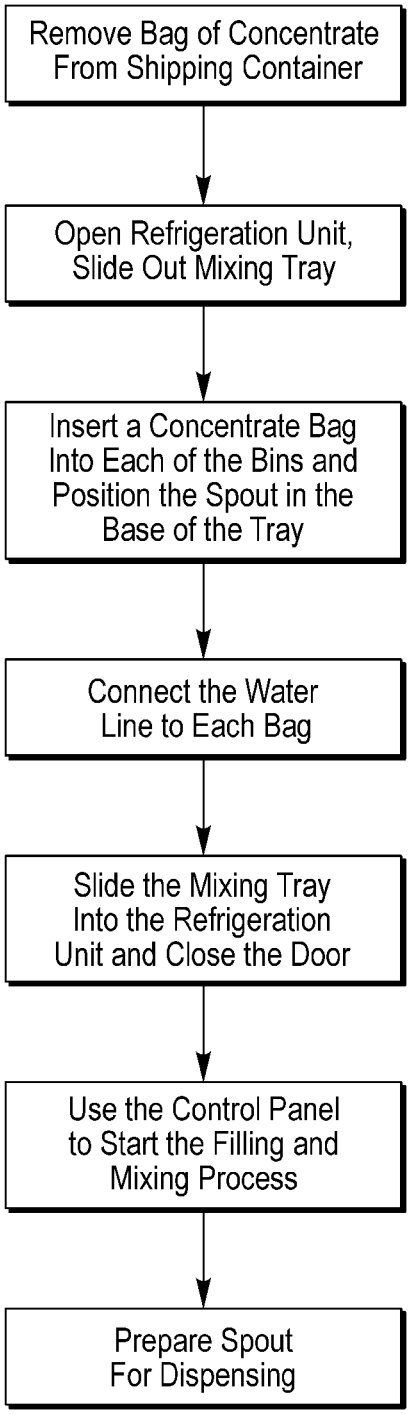
FIG. 7 is a flow chart that describes one way in which to practice the beverage dispensing system.

An illustrative process flow sequence is offered in FIG. 7. One way to use the disclosed apparatus for storing and dispensing finished beverages in a sanitary manner is as follows:

(a) providing a dispenser compartment with one or more bins;

(b) adding a low acid beverage concentrate having a pH greater than 4.6 into a flexible concentrate bag at a production facility (c) transporting the bag and its contents to a dispensing facility;

(d) placing the bag and its contents in a bin in the dispenser compartment, the bag having a first opening at a lower end region of the bag through which the beverage concentrate is introduced at the production facility before emplacement of the bag in the bin and through which the finished beverage is dispensed at a dispensing location after emplacement in the bin, and a second opening at the top of the bag, the second opening being used at the dispensing location to introduce a diluent into the bag, (c) activating a beverage homogenizing agitator subassembly situated inside the dispenser compartment in communication with the bin and outside the bag proximate the bottom of the bag, the agitator being adapted to minimize sedimentation and to mix the beverage concentrate and the diluent within the bag by agitating at least the bottom region of the bag from the outside of the bag and its contents to form the finished beverage;

(d) positioning a dispenser outlet subassembly in relation to the dispensing compartment, the subassembly including a sealed fitting located at the bottom region of the bag and a tube extending therefrom, the tube having an upstream end extending from the fitting;

an intermediate region downstream from the upstream end; and a downstream end through which the beverage is dispensed, the downstream end having a terminal portion that can be severed to open the downstream end, the dispenser outlet subassembly also being hermetically sealed and having a pinch cam attached to the dispenser compartment; and (e) moving an activation means for closing and opening the tube at the intermediate region, the dispenser outlet subassembly being in communication with the first opening of the bag, the dispenser outlet subassembly through which the finished beverage is dispensed at a dispensing location being in fluid tight communication with the bag so that any growth of bacteria is limited;

wherein the second opening for receiving the diluent is disposed upstream from the dispensing subassembly, the beverage dispensing apparatus reducing shipping and maintenance costs due to shipping concentrate rather than a finished beverage while enhancing sanitation.

It will be appreciated that the steps need not be followed in the sequence listed.

FIG. 7 is a series of process flow steps to exemplify one method of using the invention as disclosed.

Figure 8:
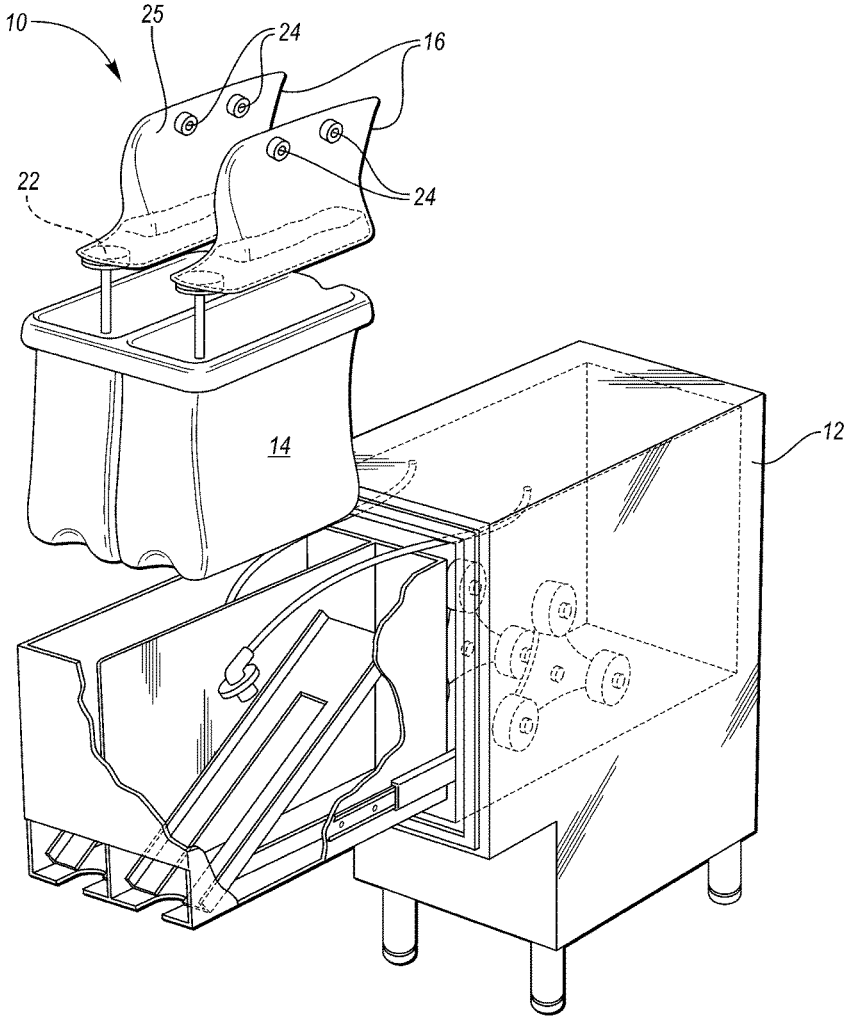
FIG. 8 depicts an optional bag design.

FIG. 8 depicts an optional bag design. In FIG. 8, a first opening 26 is provided at an upper end region of the bag. Through that opening, at a retail or dispensing facility, a concentrate can be added to the bag. A second orifice 24 is also provided at an upper end region of the bag through which a diluent may be added to the bag at the retail or dispensing facility. A third opening 22 is provided in a lower region of the bag. It is through the third opening 22 that the mixed beverage is dispensed.

What is claimed is:

1. A beverage dispensing apparatus for dispensing a finished beverage, the apparatus comprising (a) a dispenser compartment with one or more bins;

(b) a flexible concentrate bag situated within a bin in the dispenser compartment, the bag having a first opening at a lower end region of the bag through which a beverage concentrate is introduced at a production site before emplacement in the bin and through which the finished beverage is dispensed at a dispensing location after emplacement in the bin, and a second opening at the top of the bag, the second opening being used at the dispensing location to introduce a diluent into the bag, (c) the beverage concentrate including a low acid beverage concentrate having a pH greater than 4.6;

(c) a beverage homogenizing agitator subassembly situated inside the dispenser compartment in communication with the one or more bins and outside the bag proximate the bottom of the bag, the agitator subassembly being adapted to minimize sedimentation and to mix the beverage concentrate and the diluent within the bag by agitating at least a bottom region of the bag from the outside of the bag and its contents to form the finished beverage; and (d) a dispenser outlet subassembly including a sealed fitting located at the bottom region of the bag and a tube extending therefrom, the tube having an upstream end extending from the fitting;

an intermediate region downstream from the upstream end; and a downstream end through which the beverage is dispensed, the downstream end having a terminal portion that can be severed to open the downstream end, the dispenser outlet subassembly also being hermetically sealed and having a pinch cam attached to the dispenser compartment and an activation means for closing and opening the tube at the intermediate region, the dispenser outlet subassembly being in communication with the first opening of the bag, the dispenser outlet subassembly through which the finished beverage is dispensed at a dispensing location being in fluid tight communication with the bag so that any growth of bacteria is limited;

wherein the second opening for receiving the diluent is disposed upstream from the dispensing subassembly, the beverage dispensing apparatus reducing shipping and maintenance costs due to shipping concentrate rather than a finished beverage while enhancing sanitation.

2. The beverage dispensing apparatus of claim 1, further including a refrigeration unit associated with the dispenser compartment.

3. The beverage dispensing apparatus of claim 1, wherein there are two bins.

4. The beverage dispensing apparatus of claim 1, wherein the activation means includes a lever extending from a pivot.

5. The beverage dispensing apparatus of claim 1, wherein the activation means includes a button that is adapted to be depressed and is biased to an outward closed condition.

6. The beverage dispensing apparatus of claim 1, further including one or more shelves with one or more racks that receive a bag so that the bag is suspended in a vertical orientation thereby.

7. The beverage dispensing apparatus of claim 1, wherein the beverage agitator subassembly includes one or more nodules that are supported by arms radially extending from a hub, the nodules having rounded surfaces that engage a bag and agitate the bag and its contents as the beverage agitator subassembly rotates below the bag.

8. The beverage dispensing apparatus of claim 7, wherein there is one nodule in the agitator subassembly associated with a bag.

9. The beverage dispensing apparatus of claim 1, further including a control unit that influences filling a bag with a diluent and agitating the bag.

10. A beverage dispensing apparatus for dispensing a finished beverage, the apparatus comprising (a) a dispenser compartment with one or more bins;

(b) a flexible concentrate bag situated within a bin in the dispenser compartment, the bag having a first opening at an upper edge region of the bag through which a beverage concentrate is introduced at a production site;

a second opening at an upper edge region of the bag through which a diluent is added at a dispensing location; and a third opening at the lower edge region of the bag, through which the finished beverage is dispensed at the dispensing location;

(c) the beverage concentrate including a low acid beverage concentrate having a pH greater than 4.6;

(c) a beverage homogenizing agitator subassembly situated inside the dispenser compartment in communication with the one or more bins and outside the bag proximate the bottom of the bag, the agitator subassembly being adapted to minimize sedimentation and to mix the beverage concentrate and the diluent within the bag by agitating at least a bottom region of the bag from the outside of the bag and its contents to form the finished beverage; and (d) a dispenser outlet subassembly including a sealed fitting located at the bottom region of the bag and a tube extending therefrom, the tube having an upstream end extending from the fitting;

an intermediate region downstream from the upstream end; and a downstream end through which the beverage is dispensed, the downstream end having a terminal portion that can be severed to open the downstream end, the dispenser outlet subassembly also being hermetically sealed and having a pinch cam attached to the dispenser compartment and an activation means for closing and opening the tube at the intermediate region, the dispenser outlet subassembly being in communication with the first opening of the bag, the dispenser outlet subassembly through which the finished beverage is dispensed at a dispensing location being in fluid tight communication with the bag so that any growth of bacteria is limited;

wherein the second opening for receiving the diluent is disposed upstream from the dispenser outlet subassembly, the beverage dispensing apparatus reducing shipping and maintenance costs due to shipping concentrate rather than a finished beverage while enhancing sanitation.

11. A method for dispensing a finished beverage through beverage dispensing apparatus for, the method comprising the steps of comprising (a) providing a dispenser compartment with one or more bins;

(b) adding a low acid beverage concentrate having a pH greater than 4.6 into a flexible concentrate bag at a production facility (c) transporting the bag and its contents to a dispensing facility;

(d) placing the bag and its contents in a bin in the dispenser compartment, the bag having a first opening at a lower end region of the bag through which the beverage concentrate is introduced at the production facility before emplacement of the bag in the bin and through which the finished beverage is dispensed at a dispensing location after emplacement in the bin, and a second opening at the top of the bag, the second opening being used at the dispensing location to introduce a diluent into the bag, (c) activating a beverage homogenizing agitator subassembly situated inside the dispenser compartment in communication with the bin and outside the bag proximate the bottom of the bag, the agitator being adapted to minimize sedimentation and to mix the beverage concentrate and the diluent within the bag by agitating at least the bottom region of the bag from the outside of the bag and its contents to form the finished beverage;

(d) positioning a dispenser outlet subassembly in relation to the dispensing compartment, the subassembly including a sealed fitting located at the bottom region of the bag and a tube extending therefrom, the tube having an upstream end extending from the fitting;

an intermediate region downstream from the upstream end; and a downstream end through which the beverage is dispensed, the downstream end having a terminal portion that can be severed to open the downstream end, the dispenser outlet subassembly also being hermetically sealed and having a pinch cam attached to the dispenser compartment; and (e) moving an activation means for closing and opening the tube at the intermediate region, the dispenser outlet subassembly being in communication with the first opening of the bag, the dispenser outlet subassembly through which the finished beverage is dispensed at a dispensing location being in fluid tight communication with the bag so that any growth of bacteria is limited;

wherein the second opening for receiving the diluent is disposed upstream from the dispenser outlet subassembly, the beverage dispensing apparatus reducing shipping and maintenance costs due to shipping concentrate rather than a finished beverage while enhancing sanitation.

* * * * *